US006505489B2

(12) United States Patent
Berthelet et al.

(10) Patent No.: US 6,505,489 B2
(45) Date of Patent: Jan. 14, 2003

(54) METHOD AND APPARATUS FOR ULTRASONIC PEENING OF AXIAL RECESSES FOR THE ATTACHMENT OF BLADES TO A ROTOR

(75) Inventors: Benoît Jean Henri Berthelet, Maisons Alfort (FR); Francis Lucien Guy Chareyre, Franconville (FR); Willy Lionel Fradin, Vaux sur Vienne (FR); Hakim Hoffmann, Naintre (FR); Stéphane Michel Kerneis, Velizy (FR); Marie-Christine Marcelle Ntsama-Etoundi, Charenton le Pont (FR); Guillaume François Roger Simon, Montigny le Bretonneux (FR)

(73) Assignees: SNECMA Moteurs, Paris (FR); SNECMA Services, Paris (FR)

( * ) Notice: Subject to any disclaimer, the term of this patent is extended or adjusted under 35 U.S.C. 154(b) by 0 days.

(21) Appl. No.: 09/987,859

(22) Filed: Nov. 16, 2001

(65) Prior Publication Data

US 2002/0056304 A1 May 16, 2002

(30) Foreign Application Priority Data

Nov. 16, 2000 (FR) ..... 00 14768

(51) Int. Cl.[7] ..... B24C 1/00; B21D 26/14; B05D 3/12

(52) U.S. Cl. ..... 72/53; 29/90.7; 219/121.6

(58) Field of Search ..... 72/53; 29/90.7; 219/121.6, 121.68

(56) References Cited

U.S. PATENT DOCUMENTS

| | | | | | |
|---|---|---|---|---|---|
| 2,460,657 | A | * | 2/1949 | Robinson | 72/53 |
| 3,482,423 | A | * | 12/1969 | Murray et al. | 72/53 |
| 3,668,913 | A | * | 6/1972 | Morris | 72/53 |
| 3,675,452 | A | * | 7/1972 | Osmolovsky et al. | 72/53 |
| 4,419,875 | A | * | 12/1983 | DeClark et al. | 72/53 |
| 4,426,867 | A | | 1/1984 | Neal et al. | |
| 5,499,519 | A | * | 3/1996 | Brunier et al. | 72/53 |
| 5,509,286 | A | * | 4/1996 | Coulon | 72/53 |
| 5,620,307 | A | * | 4/1997 | Mannava et al. | 219/121.68 |
| 5,671,628 | A | * | 9/1997 | Halila et al. | 72/53 |
| 5,829,116 | A | * | 11/1998 | Vilon | 29/90.7 |
| 5,846,057 | A | * | 12/1998 | Ferrigno et al. | 219/121.6 |
| 5,948,293 | A | * | 9/1999 | Somer et al. | 72/53 |
| 5,950,470 | A | * | 9/1999 | Prewo et al. | 72/53 |
| 6,170,308 | B1 | * | 1/2001 | Veronesi et al. | 29/90.7 |
| 6,289,705 | B1 | | 9/2001 | Duquenne et al. | |
| 6,336,844 | B1 | | 1/2002 | Duquenne et al. | |
| 6,340,500 | B1 | * | 1/2002 | Spitsberg | 72/53 |
| 6,343,495 | B1 | * | 2/2002 | Cheppe et al. | 72/53 |

FOREIGN PATENT DOCUMENTS

| | | |
|---|---|---|
| EP | 1 101 568 A1 | 5/2001 |
| FR | 2 689 431 | 10/1993 |
| FR | 2 714 629 | 7/1995 |

* cited by examiner

*Primary Examiner*—David Jones
(74) *Attorney, Agent, or Firm*—Oblon, Spivak, McClelland, Maier & Neustadt, P.C.

(57) ABSTRACT

The invention relates to an apparatus and to a method for the surface treatment and compressive prestressing by peening of a wall of at least one oblong cavity formed in a part, said cavity opening to the outside via a lateral mouth and having two ends presenting frontal openings. The wall of the cavity is ultrasonically peened by mobilizing a plurality of beads in a chamber delimited by said wall of said cavity, a vibratory surface closing off said mouth of said cavity, and closing-off means closing off said openings, by means of a sonotrode excited by means for producing ultrasonic oscillations. The method and the apparatus are particularly intended for treating a turbine disk comprising a number of axial recesses formed in the periphery of said disk and having wall portions which diverge from each mouth.

16 Claims, 4 Drawing Sheets

METHOD AND APPARATUS FOR ULTRASONIC PEENING OF AXIAL RECESSES FOR THE ATTACHMENT OF BLADES TO A ROTOR

BACKGROUND OF THE INVENTION

1. Field of the Invention

The invention relates to a method of surface treating and compressively prestressing by peening the wall of at least one oblong cavity formed in a part, said cavity opening to the outside via a lateral mouth and having two ends capable of having frontal openings.

In particular, it is necessary to compressively prestress the wall of an axial recess of a turbomachine rotor capable of containing a blade root, the lines of contact between the axial recess and the blade root of which are highly stressed. What happens in operation is that the turbine or fan blades, immobilized in the axial recesses by various means, are subjected to considerable centrifugal forces leading to significant frictional wear at these lines of contact. This frictional wear reduces the life of the parts in operation and leads to them having to be changed regularly.

2. Summary of Prior Art

In order to improve the fatigue strength of the turbine rotor and to harden the surface of the axial recesses in the region of the lines of contact, it is known practice for the axial recesses to be peened using beads ejected from a compressed air nozzle introduced into each recess. The beads cause permanent compression of the treated surface over a shallow thickness, opposing the onset and propagation of cracks at the surface of the part.

These nozzles are able to project only microbeads of a diameter smaller than 1 mm, and typically of between 0.3 mm and 0.5 mm.

This method is necessarily lengthy because the entire surface area of the cavity is treated only by a succession of local treatments which may, furthermore, introduce unwanted local deformation and cause the incrustation of bead residue. Furthermore, in this method, the distribution of the beads, both in terms of position and in terms of speed, follows a Gaussian law.

In addition, the peening performed is light in order not to generate excessive roughness in the region of the treated zone, and this leads to a limited hardening of the surface. The problem is that since the diameter of the projected beads is small, the more intense the peening, the greater the damage caused to the surface finish.

Finally, the method, which involves numerous parameters, is difficult to control and difficult to reproduce.

SUMMARY OF THE INVENTION

The object of the invention is to propose a method for peening oblong cavities, particularly axial recesses of turbine rotors, which makes it possible to create reproducible prestresses in all the cavities, in a relatively short period of time, while at the same time allowing relatively intense peening, that is to say a greater depth of compression at the surface. This is to be achieved safely, while at the same time limiting the damage caused to, or incrustation of, the treated surface.

According to the invention, there is provided a method of surface treating and compressively prestressing by peening a wall of at least one oblong cavity formed in a part, said cavity opening to the outside via a lateral mouth and having two ends presenting frontal openings, said method comprising the steps of providing a sonotrode arranged within a sleeve, said sonotrode having a vibratory surface and ultrasonic means for vibrating said vibratory surface, and said sleeve having opposed closing-off means capable of closing off the frontal openings of said cavity, placing a plurality of beads of a predetermined diameter on said vibratory surface of said sonotrode with said sonotrode arranged in an intermediate position in which said sleeve surrounds said vibratory surface, placing said lateral mouth of said cavity facing said sonotrode, moving said sonotrode, supporting said plurality of beads, together with said sleeve substantially vertically toward a raised peening position in which said closing-off means close off said frontal openings of said cavity and in which said sonotrode is disposed facing said lateral mouth to delimit, together with said sleeve, said closing-off means and said cavity, a chamber sealed to said beads, and operating said ultrasonic means to vibrate said vibratory surface of said sonotrode whereby said beads are mobilized in said chamber to conduct ultrasonic peening of said wall of said cavity.

The method makes it possible to obtain a uniform distribution of the beads within the chamber. As the beads within the chamber travel in random directions, they strike the walls of the cavities at varying angles, and this improves the surface finish by comparison with beads projected by a nozzle in one predominant direction.

Furthermore, the entirety of the surface is subjected at the same time to the impacts of beads, and this considerably diminishes the risk of deformation of the cavity, particularly of the recess containing the blade root.

To mobilize the plurality of beads, all that is required is for at least one bead to come into contact with the vibratory surface when the sonotrode is excited. Hence the sonotrode may be arranged obliquely with respect to the vertical.

According to a preferred embodiment of the invention, the method further includes the step of moving said sonotrode substantially vertically with respect to said sleeve so that said vibratory surface closes off said mouth after the step of moving said sonotrode and said sleeve together toward said raised peening position.

As the volume in which the plurality of beads is distributed is smaller than the volume obtained when the vibratory surface remains outside the mouth, the method requires a shorter peening treatment time.

In this case, having peened the wall of a cavity, the sonotrode is moved toward its intermediate position in the sleeve, the treated cavity is replaced with another cavity to be treated, the sonotrode is moved toward its peening position and the wall of the other cavity to be treated is ultrasonically peened.

If the vibratory surface is not introduced into the mouth, having peened the wall of a cavity, the treated cavity is replaced with another cavity to be treated, and the wall of the other cavity to be treated is ultrasonically peened.

When the part comprising at least one cavity to be treated is not circular, or alternatively when the method is applied for continuously treating a succession of parts which have just one cavity, the geometry of the part is not always suited to the apparatus and it is necessary to move both the vibratory surface and the closing-off means in order to clear the space available between the steps of respectively bringing in each piece and/or cavity.

When the sleeve has to move back in order to change from one cavity to another because of the geometry of the part, having peened the wall of a cavity, the sonotrode and the sleeve are moved together toward a lowered position, the treated cavity is replaced with another cavity to be treated, the sonotrode and the sleeve are moved together toward the raised peening position, and the wall of the other cavity to be treated is ultrasonically peened.

According to an alternative embodiment, the method further includes the steps of moving said sonotrode toward its intermediate position in said sleeve after peening the wall of said cavity, moving said sonotrode and said sleeve together toward a lowered position, replacing said treated cavity with another cavity to be treated, moving said sonotrode and said sleeve together toward said raised peening position, moving said sonotrode substantialy vertically with respect to said sleeve so that said vibratory surface closes off said mouth, and ultrasonically peening the wall of said other cavity to be treated.

When the method is used to treat a circular part, for example a rotor rim, comprising a number of axial cavities formed in the periphery of said rotor rim and having wall portions which diverge from each mouth, the rotor rim is turned stepwise about its axis of rotation arranged horizontally so as bring each axial cavity in turn to face the sonotrode after a cavity has been treated.

According to a further preferred embodiment of the invention, a deflector is placed in the cavity so as to encourage the peening of the divergent wall portions of the lateral mouth.

The deflector may be of approximately triangular geometry with sides parallel to the divergent wall portions so as to reduce the effect of the peening of the zone situated between said deflector and the bottom of the cavity.

At the end of the treatment, according to a yet further preferred embodiment, the sonotrode is moved substantially vertically toward a lowered position in the sleeve, in which position the plurality of beads can be driven from the vibratory surface toward a reservoir through slots formed in the sleeve, after the cavities in the part have been peened.

Thus, the beads can easily be recovered so that they can either be reused in a subsequent treatment or be replaced.

According to an even yet further preferred embodiment, the predetermined diameter of said beads exceeds 0.8 mm.

The beads used in the method according to the invention have a larger diameter than the diameter of the beads that can be projected by a nozzle, which means that the peening can be more intense while at the same time causing less substantial damage to the surface.

The invention also provides an apparatus for use in carrying out the method, said apparatus comprising a sonotrode mounted in a sleeve equipped with closing-off means capable of closing off frontal openings of said cavity, said sonotrode being capable of projecting beads of a predetermined diameter into a chamber delimited by said wall of said cavity, said vibratory surface of said sonotrode, said sleeve and said closing-off means, means for producing ultrasonic oscillations capable of exciting said sonotrode, first means for moving said sonotrode substantially vertically, and second means for moving said sleeve substantially vertically, a first clearance, smaller than said diameter of said beads, being formed between said sonotrode and said sleeve.

According to a preferred embodiment, a second clearance, smaller than said diameter of said beads, is formed between the mouth of said cavity and said vibratory surface arranged in said mouth.

According to a further preferred embodiment, the apparatus further comprises a third clearance, smaller than the diameter of the beads, formed between one end of said sleeve and said mouth, which, when said vibratory surface is not closing off said mouth, ensures said chamber is sealed correctly.

The apparatus may comprise a number of acoustic assemblies each comprising a sonotrode and a sleeve, arranged around the rotor rim, said acoustic assemblies being capable of moving in an axial direction of the rotor rim.

The various elements of the apparatus are arranged in such a way that no bead can jam said elements that are capable of moving. Furthermore, the sonotrode and the sleeve comprising the closing-off means have a geometry tailored to the shape of the cavity to be treated. In particular, the vibratory surface is of a shape that complements the space left by mouth, and the closing-off means are formed in such a way as to close off the openings of said cavity correctly.

According to a yet further preferred embodiment, said second means for moving said sleeve are capable of moving said closing-off means and said sonotrode at the same time.

According to an even yet further preferred embodiment, said first means for moving said sonotrode and said second means for moving said sleeve can be operated simultaneously.

At the beginning of the treatment, the sleeve and the sonotrode are placed in an intermediate position in which the space generated by the closing-off means of said sleeve and the vibratory surface of said sonotrode constitutes a reservoir for the beads. Next, said sleeve and said sonotrode supporting the beads are moved jointly with the same movement. Finally, the sonotrode and/or the closing-off means can be moved individually, depending on the geometry of the cavity to be treated, until, respectively, the vibratory surface closes off the mouth of the cavity and the closing-off means close off the openings of the cavity.

According to yet another preferred embodiment, said apparatus further comprises support means for supporting at least one part that is to be treated and means for driving said support means to bring a cavity step by step over said sonotrode.

The apparatus advantageously comprises means for driving the beads from the vibratory surface toward a reservoir. These simple means make it possible to drive the beads towards the reservoir during a treatment if necessary, or at the end thereof, either to refresh the beads or to replace them.

BRIEF DESCRIPTION OF THE DRAWINGS

FIG. 1 shows a rotor rim 1 which comprises a number of approximately axial recesses 2 formed in the periphery of the rotor rim 1 and uniformly spaced about the axis of rotation 1A of the rotor rim. These recesses 2 have a frontal opening 3 at each end. These recesses 2 are in the shape of dovetails and have a mouth 2A open radially toward the outside and of approximately straight shape so as allow the fitting of approximately dovetail-shaped blade roots 4 of fan blades 6. The recesses 2 may be straight or curved.

Each blade root 4 is mounted axially by sliding in a recess 2. A wedge (not depicted) which holds the blade root 4 against the walls of the corresponding recess 2 may be engaged between the blade root 4 and the bottom of the recess 2.

Figure 1:
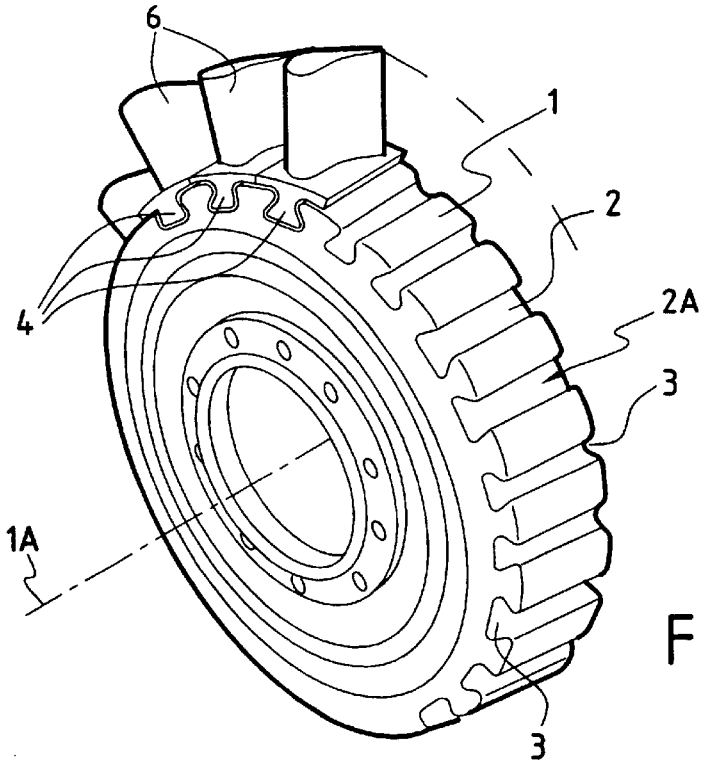
FIG. 1 is a front perspective view of a rotor rim having axial cavities formed at the periphery of the rotor rim.
Figure 2:
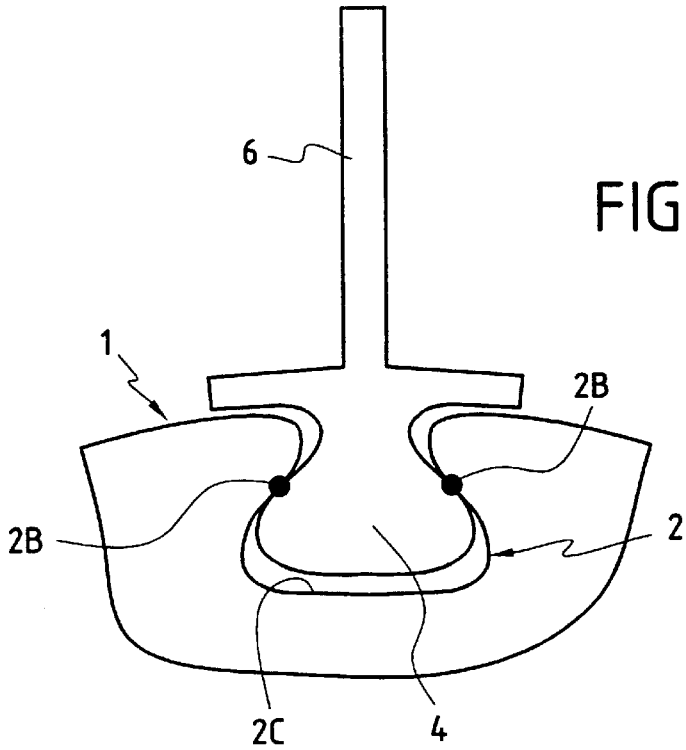
FIG. 2 is a front view of a fan blade arranged in an axial cavity of FIG. 1.

FIG. 2 shows that walls of the recess 2 and the blade root 4 rest on one another along two lines of contact 2B.

The object of the invention is to propose a method and an installation for compressively prestressing a wall 2C of each recess 2 and, in particular, the regions of the two lines of contact 2B, so as to increase the resistance to wear of these lines of contact 2B, the wear being brought about by friction between the blade root 4 and the wall of the recess 2, and thus improve the fatigue strength of the rotor rim 1.

Figure 3:
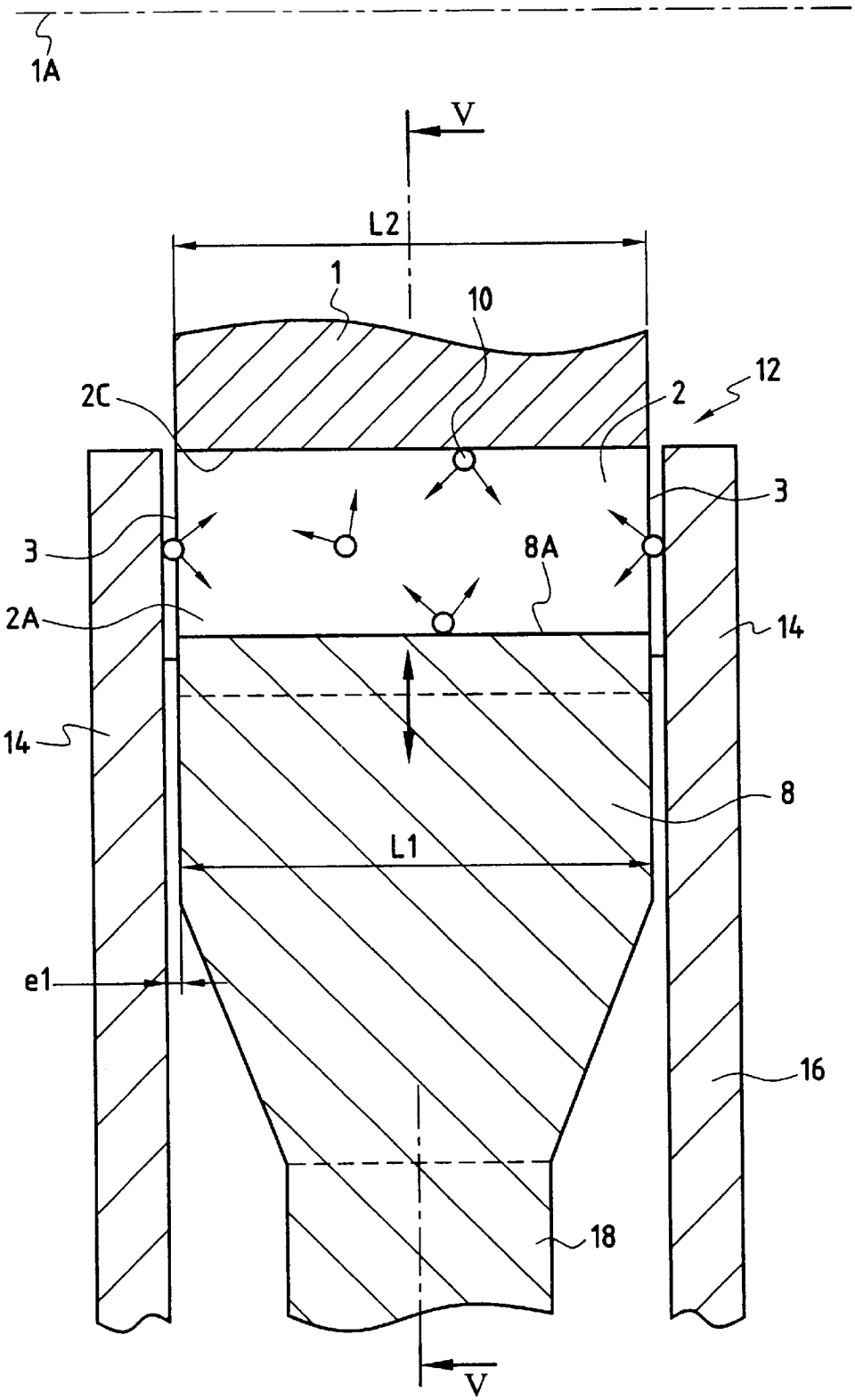
FIG. 3 is an axial section of an installation for carrying out the invention, a sleeve and a sonotrode being placed in a raised peening position.
Figure 5:
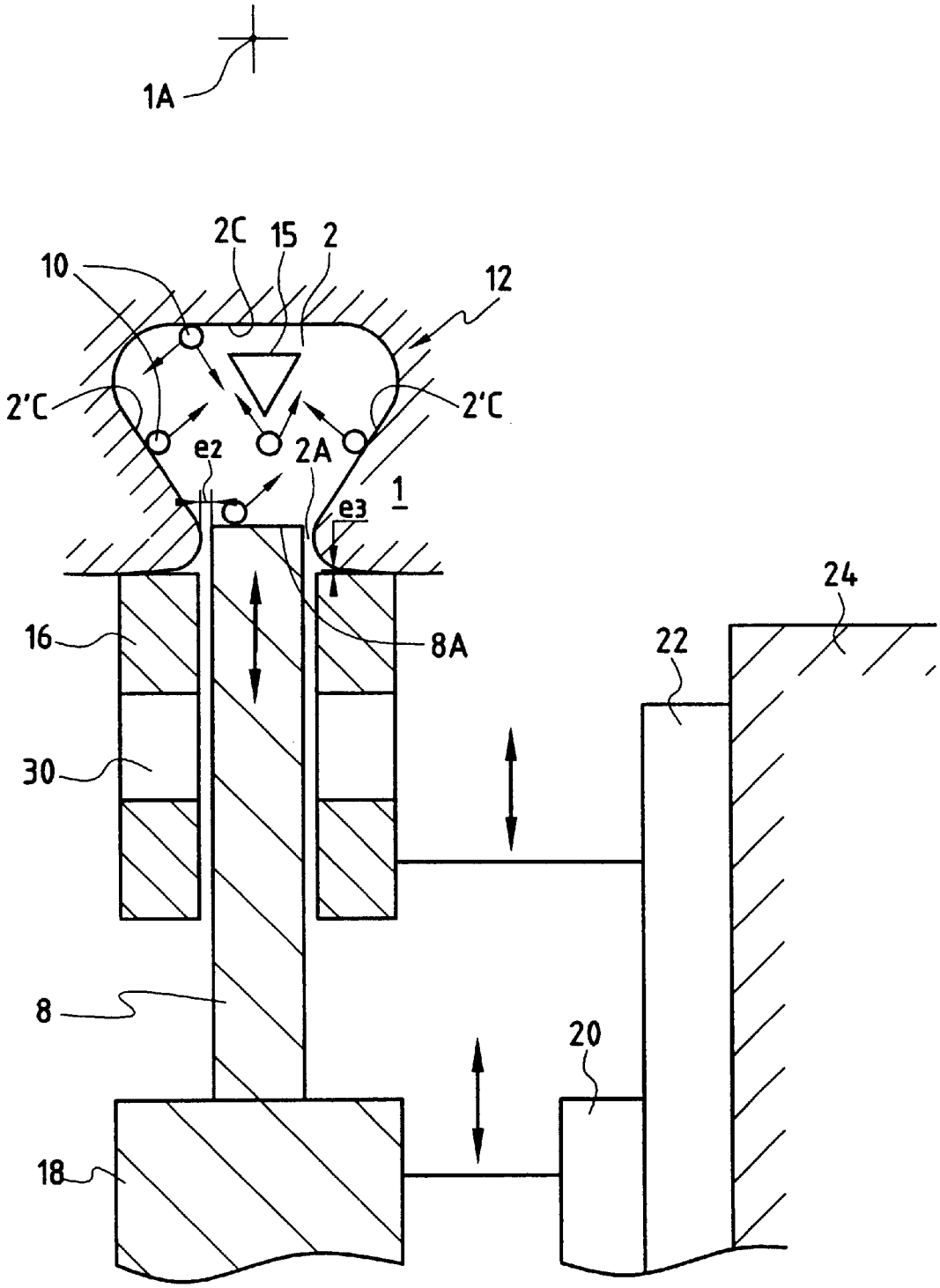
FIG. 5 is a section of FIG. 3 on V—V.

FIGS. 3 and 5 show an example of an apparatus used for implementing the method and in which just one acoustic assembly is used, said accoustic assembly being capable of moving vertically. The accoustic assembly essentially comprises a sonotrode 8 arranged in a sleeve 16 equipped with closing-off cheeks 14. The apparatus is positioned under the rotor rim 1. The sonotrode 8, and the sleeve 16, are placed in a raised peening position as depicted in FIG. 3. In this raised peening position, the sonotrode 8 preferably closes off the mouth 2A, and the closing-off cheeks 14 formed on the sleeve 16 close off the two openings 3.

Beads 10 of a diameter of between 0.8 mm and 5 mm, preferably equal to 1 mm, are projected by an upwardly-orientated vibratory surface 8A of the sonotrode 8 into a chamber 12 delimited by the wall 2C, the vibratory surface 8A and the closing-off cheeks 14. The vibratory surface 8A is excited by a vibration generator 18, for example a quartz generator, so as to mobilize a plurality of beads 10 in the chamber 12.

A clearance e1 formed between the sonotrode 8 and the sleeve 16 is smaller than the diameter of the beads 10, which means that no bead 10 can slip between the vibratory surface 8A and the sleeve 16.

Figure 4:
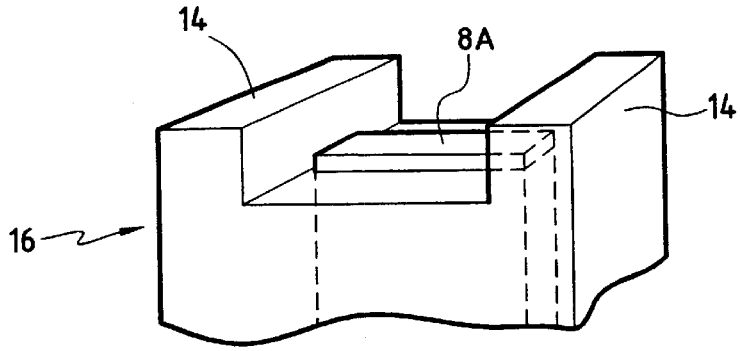
FIG. 4 corresponds to FIG. 3, and is a perspective view of the sleeve containing the sonotrode placed in the raised peening position inside said sleeve.

With reference to FIGS. 3 to 5, the vibratory surface 8A is approximately rectangular and has a length L1 approximately equal to the length L2 of the recess 2 measured axially. The sonotrode 8 is in the raised peening position in the sleeve 16 which borders the vibratory surface 8A. The closing-off cheeks 14 are of simple shape, for example rectangular, so as to completely cover up the openings 3. The width of the vibratory surface 8A is approximately equal to the width of the mouth 2A.

FIG. 5 shows that the recess 2 is of concave shape with walled portions 2'C which diverge from the mouth 2A. A deflector 15 borne by the closing-off cheeks 14 has been introduced into the recess 2. Said deflector 15 is triangular with sides approximately parallel to the wall portions 2'C and to the bottom of the recess. In particular, it makes it possible to lessen the effect of the peening of the bottom of the recess and to increase the peening of the walls 2'C.

A clearance e2 formed between the vibratory surface 8A of the sonotrode 8 and the mouth 2A is smaller than the diameter of the beads 10 so that no bead 10 can escape from the chamber 12.

If the vibratory surface 8A does not close off the mouth during peening, a third clearance e3 lying between one end 16A of the sleeve 16 and the mouth 2A ensures that the chamber 12 is sealed.

A first slide 20 allows the sonotrode 8 to be moved vertically by causing said sonotrode 8 to slide in the sleeve 16. A second slide 22, borne by a support structure 24, itself allows the sonotrode 8 and the sleeve 16 both to move approximately vertically. Operating means (not depicted) allow said first slide 20 and said second slide 22 to be operated.

The first slide 20 may be borne either by the second slide 22, as shown in FIG. 5, or by the support structure 24, in which case the two slides 20 and 22 need to be operated synchronously in order to raise the sonotrode 8 and the sleeve 16 together toward the raised peening position.

Figure 6:
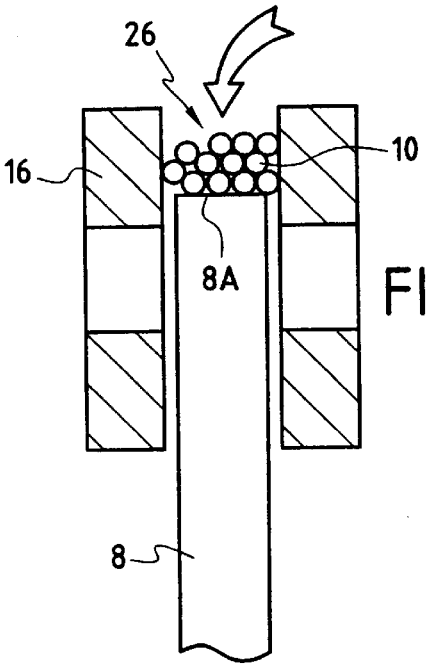
FIG. 6 is a section through the sleeve containing the sonotrode in its intermediate position with a plurality of beads on a vibratory surface of the sonotrode.

Before beginning the operation of treating an axial recess 2, the sonotrode 8 is placed in an intermediate position in the sleeve 16, in which position the space delimited by the sleeve 16 and the vibratory surface 8A constitutes a receptacle 26 able to contain the dose of beads 10 deposited on the vibratory surface 8A, as depicted in FIG. 6.

Having fixed the rotor rim 1 by holding means (not depicted), a first cell 2 is brought to face the sonotrode 8 by rotating the rotor rim 1 about its axis of rotation 1A using drive means (not depicted). The drive means for example comprise a stepping motor.

The sonotrode 8 and the sleeve 16 are moved to their raised peening position then the first recess 2 is peened by actuating the vibration generator 18. As soon as the peening of the first recess 2 is over, the sonotrode 8 is extricated from the mouth 2A toward its intermediate position, then a second recess 2 is brought up to face the sonotrode 8 by rotating the rotor rim 1 through an angle equal to the angle separating two consecutive axial recesses 2 about its axis of rotation 1A, and so on and so forth until all of the axial recesses 2 formed on the rotor rim 1 have been treated.

Figure 7:
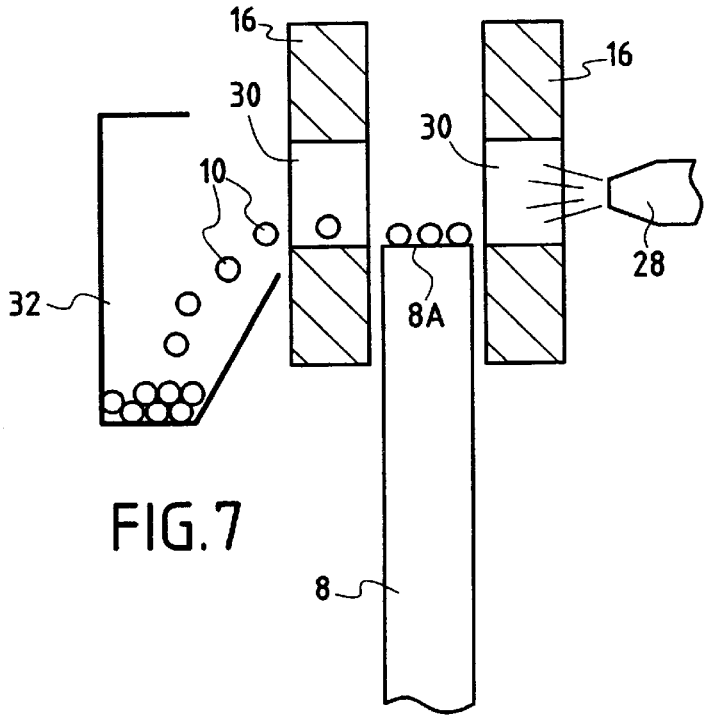
FIG. 7 is a section through the sleeve containing the sonotrode in its lowered position, showing a reservoir for the beads, and driving means for driving the beads into said reservoir.

At the end of the treatment, or on demand, the sonotrode 8 is withdrawn to its lower position depicted in FIG. 7, in which the beads 10 are extricated. The beads 10 are, for example, blown from the surface 8A using a fan 28 through slots 30 formed in the sleeve 16 and recovered in a reservoir 32. Said beads 10 can then be refreshed or alternatively replaced with a view to a later treatment.

It is to be noted that the sonotrode 8 can be moved in an oblique direction without departing from the scope of the invention. What is important is that there should be at least one bead 10 in the receptacle 26 in contact with the surface 8A when the sonotrode 8 is started up, so as to mobilize the plurality of beads.

We claim:

1. A method of surface treating and compressively prestressing by peening a wall of at least one oblong cavity formed in a part, said cavity opening to the outside via a lateral mouth and having two ends presenting frontal openings, said method comprising the steps of:

a) providing a sonotrode arranged within a sleeve, said sonotrode having a vibratory surface and ultrasonic means for vibrating said vibratory surface, and said sleeve having opposed closing-off means capable of closing off the frontal openings of said cavity;

b) placing a plurality of beads of a predetermined diameter on said vibratory surface of said sonotrode with said sonotrode arranged in an intermediate position in which said sleeve surrounds said vibratory surface;

c) placing said lateral mouth of said cavity facing said sonotrode, d) moving said sonotrode, supporting said plurality of beads, together with said sleeve substantially vertically toward a raised peening position in which said closing-off means close off said frontal openings of said cavity and in which said sonotrode is disposed facing said lateral mouth to delimit, together with said sleeve, said closing-off means and said cavity, a chamber sealed to said beads; and e) operating said ultrasonic means to vibrate said vibratory surface of said sonotrode whereby said beads are mobilized in said chamber to conduct ultrasonic peening of said wall of said cavity.

2. A method according to claim 1, including the step of moving said sonotrode substantially vertically with respect to said sleeve so that said vibratory surface closes off said mouth after the step of moving said sonotrode and said sleeve together toward said raised peening position.

3. A method according to claim 2, further including the steps of:

moving said sonotrode toward its intermediate position in said sleeve after peening said wall of said cavity;

replacing said treated cavity with another cavity to be treated;

moving said sonotrode toward its peening position; and ultrasonically peening the wall of said other cavity to be treated.

4. A method according to claim 1, further including the steps of:

replacing said cavity with another cavity to be treated after peening said wall of said cavity; and ultrasonically peening the wall of said other cavity to be treated.

5. A method according to claim 1, further including the steps of:

moving said sonotrode and said sleeve together toward a lowered position after peening the wall of said cavity;

replacing said treated cavity with another cavity to be treated;

moving said the sonotrode and said sleeve together toward said raised peening position; and ultrasonically peening the wall of said other cavity to be treated.

6. A method according to claim 2, further including the steps of:

moving said sonotrode toward its intermediate position in said sleeve after peening the wall of said cavity;

moving said sonotrode and said sleeve together toward a lowered position;

replacing said treated cavity with another cavity to be treated;

moving said sonotrode and said sleeve together toward said raised peening position;

moving said sonotrode substantialy vertically with respect to said sleeve so that said vibratory surface closes off said mouth; and ultrasonically peening the wall of said other cavity to be treated.

7. A method according to claim 4, wherein said part is a circular rotor rim having an axis of rotation arranged horizontally, a periphery and a plurality of axial cavities, formed in said periphery, each of said cavities, having wall portions which diverge from said mouth thereof, and wherein said cavity replacing step comprises turning said rotor rim stepwise about said axis of rotation so as to bring each axial cavity in turn to face said sonotrode after a cavity has been treated.

8. A method according to claim 7, including the step of placing a deflector in the cavity so as to encourage the peening of said divergent wall portions of said lateral mouth.

9. A method according to claim 1, wherein said predetermined 25 diameter of said beads exceeds 0.8 mm.

10. An apparatus for use in carrying out the method according to claim 1, comprising:

a sonotrode mounted in a sleeve equipped with closing-off means capable of closing off frontal openings of said cavity, said sonotrode being capable of projecting beads of a predetermined diameter into a chamber delimited by said wall of said cavity, said vibratory surface of said sonotrode, said sleeve and said closing-off means;

means for producing ultrasonic oscillations capable of exciting said sonotrode;

first means for moving said sonotrode substantially vertically; and second means for moving said sleeve substantially vertically;

a first clearance, smaller than said diameter of said beads, being formed between said sonotrode and said sleeve.

11. An apparatus according to claim 10, wherein a second clearance, smaller than said diameter of said beads, is formed between the mouth of said cavity and said vibratory surface arranged in said mouth.

12. An apparatus according to claim 11, wherein a third clearance, smaller than said diameter of said beads, is formed between one end of said sleeve and said part.

13. An apparatus according to claim 10, wherein said second means for moving said sleeve are capable of moving said closing-off means and said sonotrode at the same time.

14. An apparatus according to claim 10, wherein said first means for moving said sonotrode and said second means for moving said sleeve can be operated simultaneously.

15. An apparatus according to claim 10, which further comprises support means for supporting at least one part that is to be treated, and means for driving said support means to bring one cavity step by step over said sonotrode.

16. An apparatus according to claim 10, which further comprises means for driving said plurality of beads from said vibratory surface toward a reservoir.

* * * * *

UNITED STATES PATENT AND TRADEMARK OFFICE

CERTIFICATE OF CORRECTION

PATENT NO. : 6,505,489 B2 
DATED : January 14, 2003
INVENTOR(S) : Benoit J. Berthelet et al.

It is certified that error appears in the above-identified patent and that said Letters Patent is hereby corrected as shown below:

Column 8,
Line 16, delete "25".

Signed and Sealed this

Twenty-first Day of October, 2003

JAMES E. ROGAN
*Director of the United States Patent and Trademark Office*